US005152719A

United States Patent [19]

Nolan

[11] Patent Number: 5,152,719

[45] Date of Patent: Oct. 6, 1992

[54] ROCKING TOY WITH A CAROUSEL POLE

[75] Inventor: Robert J. Nolan, Columbus, Miss.

[73] Assignee: Par Industries, Inc., Medina, Ohio

[21] Appl. No.: 707,445

[22] Filed: May 30, 1991

[51] Int. Cl.[5] ..... A63G 17/00

[52] U.S. Cl. ..... 472/101; 472/102

[58] Field of Search ..... 472/95-105, 472/110, 114, 135

[56] References Cited

U.S. PATENT DOCUMENTS

| | | | |
|---|---|---|---|
| 110,709 | 11/1871 | Williams | 472/102 X |
| 2,743,104 | 4/1956 | Dodson | 472/102 X |
| 2,541,718 | 2/1951 | Powlick | 472/101 X |
| 2,627,419 | 2/1953 | Lindenbein | 472/95 X |
| 3,999,771 | 12/1976 | Lohr | 472/99 X |

*Primary Examiner*—Richard E. Chilcot, Jr.
*Attorney, Agent, or Firm*—Renner, Kenner, Greive, Bobak, Taylor & Weber

[57] ABSTRACT

A rocking type ride-on toy (10) having an animal replica (11) secured to the frame (45) of a platform (12). The platform (12) has a pair of spaced rocker members (33 and 34). Cross bars (35 and 36) connect the ends of the rocker members (33 and 34) to maintain the parallel disposition thereof. A transverse, arch supporting member (46) is secured between the laterally spaced rocker members (33 and 34) and medially the ends of the rocker member (33 and 34), and an arch member is presented from the supporting member (46). A rearward connecting rib (25) is presented from the replica (11) and attached to the arch member (55) to assist in supporting the replica (11). A longitudinal beam member (75) is secured between the transverse, arch supporting member (46) and the forward cross bar (35). A vertically extending carousel pole (85) extends upwardly from the longitudinal beam member (75) to pass through an aperture (32) in the replica (11). The pole (85) is attached to a forward connecting rib (24) such that the pole (85) assists in supporting the replica (11). The pole (85) also presents a vertically extending grip portion (86) to be grasped by a rider. Foot rests (95) are also supported from the pole (85).

4 Claims, 5 Drawing Sheets

ROCKING TOY WITH A CAROUSEL POLE

TECHNICAL FIELD

The present invention relates generally to toys for children. More particularly, the present invention relates to rocking toys. Specifically, the present invention relates to rocking type ride-on employing a replica of an animal body on which the child sits.

BACKGROUND OF THE INVENTION

Typical rocking toys use the replica of a horse, or some other animal, which is supported on rockers in the form of arcuate, floor engaging members. The rockers are generally interconnected by a pair of transversely extending frame members, and the animal replica is generally supported on the rockers by attaching the legs of the animal replica to the rockers.

The replica is usually provided with a saddle-like seat, or other supporting surface on which the rider sits. A pair of foot rests, which are often in the configuration of stirrups, extend laterally from the replica. Hand grips, often in the form of pegs, are provided which extend transversely from the replica, generally in the area of the neck, or head, portion.

When using prior art rocking toys, the rider is generally required to lean forwardly from the seating portion in order to reach the hand grips. As such, the rider is not sitting erect. This forced posture can tire the rider, and the taller the rider, the more pronounced is the degree to which the child must lean forwardly while riding—i.e., rocking—on the toy. The forward leaning posture is even more pronounced when the rider stands on the foot rests.

Partly as a result of these inherent problems, the true rocking horse gave way to the spring mounted ride-on toy which is supported from a fixed (i.e., non-rocking) frame. The spring mounted rocking toy also employs the replica of an animal, most often a horse. The spring mounted arrangement permits the initial attitude of the replica to be such that the rider is more erect while in the sitting position, but even on these toys the rider is required to adopt an uncomfortable forwardly leaning posture, particularly if the child attempts to stand on the foot rests. It should also be understood that the spring mounted replica can not provide a rocking motion that is desirably limited to the sagittal plane of the toy. Rather, the movement is more erratic, with some components of the complex, and erratic, motion being sagittal and some being lateral. Particularly for the young chile, this erratic motion can be disconcerting.

SUMMARY OF THE INVENTION

It is, therefore, a primary object of the present invention to provide an improved rocking type ride-on toy that employs the replica of an animal on which the rider sits.

It is a another object of the present invention to provide an improved rocking type ride-on toy which employs a unique supporting frame.

It is a further object of the present invention to provide an improved rocking type ride-on toy, as above, wherein the hand grip for the rider is comprised of a vertical pole member that extends vertically upwardly through the replica of the animal to a sufficient height that is can be used effectively as a hand grip, even when the rider is standing on the foot rests.

It is still another object of the present invention to provide an improved rocking type ride-on toy, as above, which employs a platform for supporting the animal replica, the platform having a pair of laterally spaced, arcuate, rocker members, longitudinally spaced cross bars interconnecting the arcuate rocker members, preferably at the ends thereof, a transverse, arch supporting member extending between, and connected to, the arcuate rocker members, a longitudinal beam member extending between, and connected to, the transverse, arch supporting member and the forward cross bar, an arch being secured to the supporting member for connection to the replica, and a pole extending substantially vertically upwardly from the longitudinal beam member.

These and other objects of the invention, as well as the advantages thereof over existing and prior art forms, which will be apparent in view of the following detailed specification, are accomplished by means hereinafter described and claimed.

In general, a rocking type ride-on toy embodying the concepts of the present invention utilizes a unique platform for supporting the replica and which presents a hand grip means that will permit the rider of the toy to maintain an erect position while sitting on the replica or standing on the foot rests. Specifically, the present rocking type ride-on toy has an animal replica supported from a platform. The frame of the platform utilizes a pair of laterally spaced rocker members. A forward cross bar interconnects the rocker members at the forward ends thereof, and a rearward cross bar interconnects the rocker members at the rearward ends thereof. A transverse, arch supporting member interconnects the rocker members medially the forward and rearward ends thereof and a longitudinal beam member interconnects the forward cross bar with a transverse, arch supporting member substantially midway between the rocker members.

An animal replica having a torso with an upper surface and an under surface is supported from the platform. A seating portion is presented from the upper surface of the torso. A connecting rib presented from the under surface of the torso, and located rearwardly of the seating portion, is connected to an arch which extends upwardly from the transverse, arch supporting member.

A forward connecting rib is also presented from the under surface of the torso, and the forward connecting rib is located forwardly of the seating portion.

An aperture extends vertically through the replica, and a pole extends upwardly from the longitudinal beam member to pass through the aperture and present a vertically oriented hand grip for the rider. Means are provided to secure the pole to the longitudinal beam member and the forward connecting rib.

The platform is preferably sufficiently wider than the width of the animal replica to provide a more stable frame than was provided with earlier rocking toy animals. The transverse, arch supporting member and the longitudinal beam member are effective to reduce the lateral separating stress on the platform frame while the transverse cross bars provide additional strength for that same purpose.

One exemplary embodiment of rocking type ride-on toy embodying the concepts of the present invention is deemed sufficient to effect a full disclosure of the subject invention. Accordingly, the exemplary rocking type ride-on toy is described in detail without attempting to show all of the various forms and modifications in which the invention might be embodied; the invention being measured by the appended claims and not by the details of the specification.

DESCRIPTION OF AN EXEMPLARY EMBODIMENT

Figure 1:
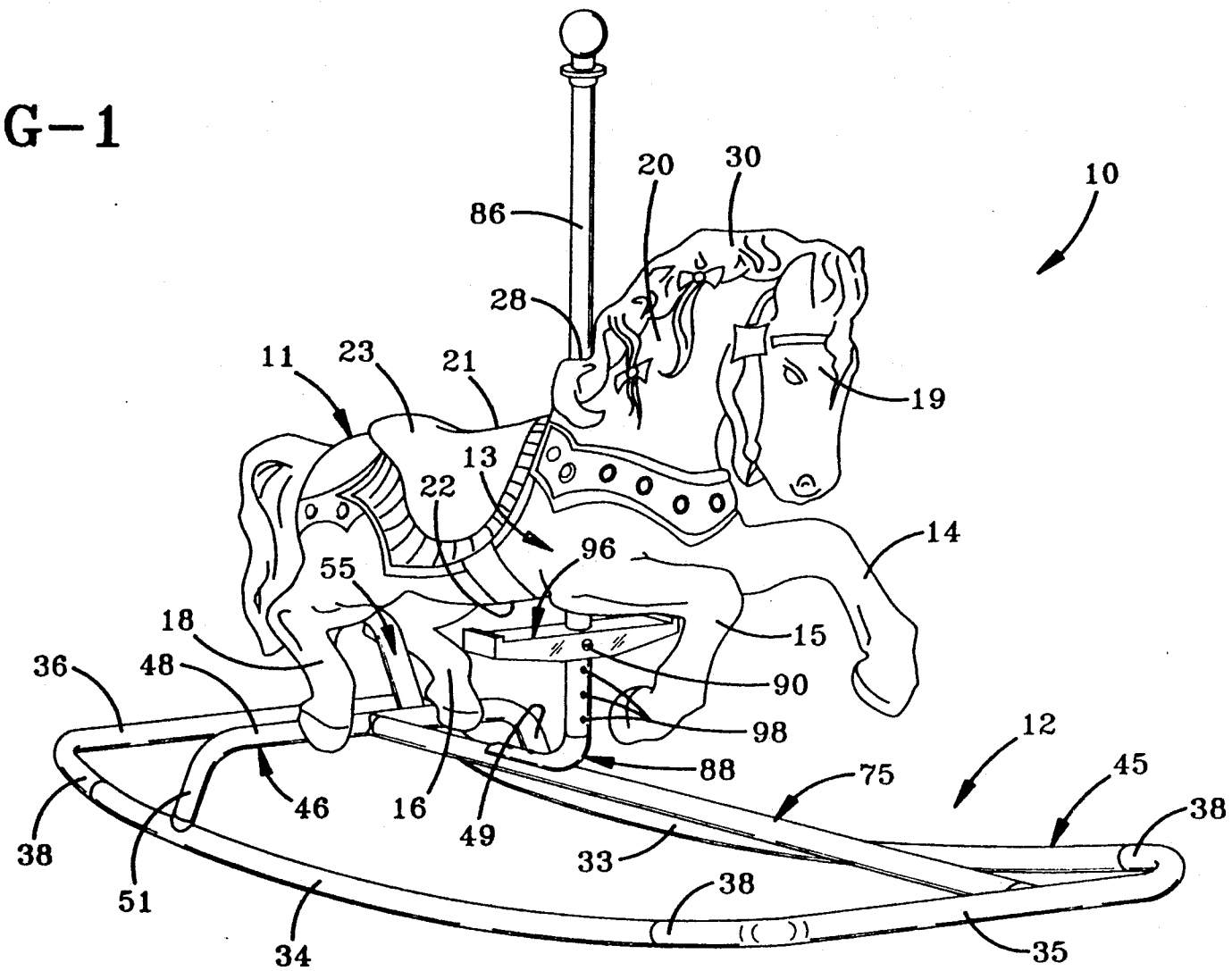
FIG. 1 is a perspective view of a rocking type ride-on toy in the nature of a rocking horse representing an exemplary embodiment of the present invention.

Referring to the drawings, wherein like characters represent the same or corresponding parts throughout the several views, a rocking type ride-on toy is identified generally by the numeral 10. With particular reference to FIG. 1, the rocking type ride-on toy 10 may employ the replica 11 of an animal—a horse, as shown—and the replica 11 is supported from a platform 12. The replica 11 has a torso 13, forelegs 14 and 15, hind legs 16 and 18, a head 19 and a neck 20. The torso 13 of the replica 11 has an upper surface 21 and an under surface 22. A seating portion, which may present the appearance of a saddle, 23 is presented from the upper surface 21 to accommodate a rider, not shown.

Figure 2:
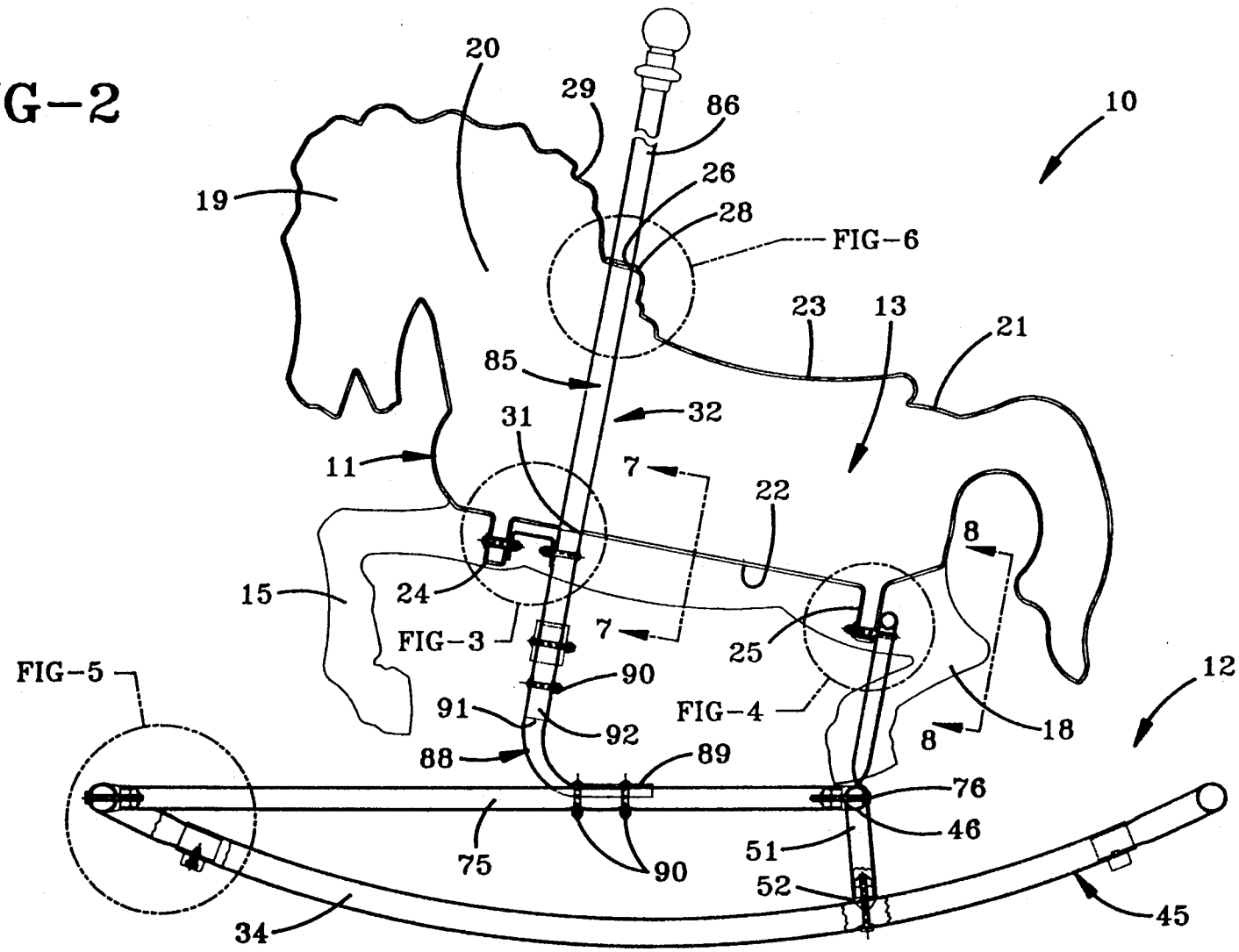
FIG. 2 is an enlarged, vertical section through the assembly depicted in FIG. 1.
Figure 3:
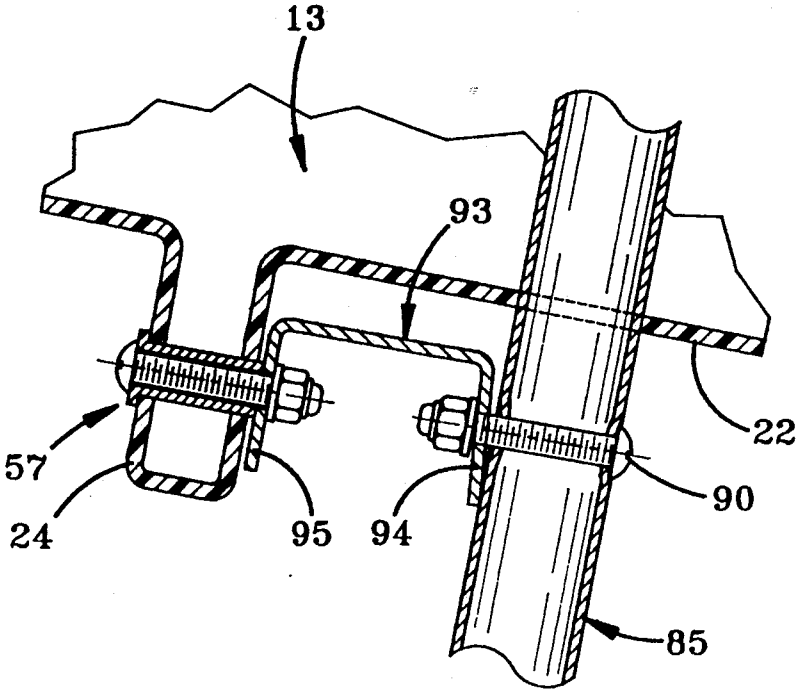
FIG. 3 is an enlarged area of FIG. 2—as designated by the appropriately identified chain line circle in FIG. 2—depicting the interconnection between the undersurface on the torso of the animal replica and the vertically extending pole on the frame.

The under surface 22 of the torso 13 presents a forward connecting rib 24 which, as best seen in FIGS. 2 and 3, is located forwardly of the seating portion 23 and extends laterally between the forelegs 14 and 15 and downwardly from the under surface 22 at a location in proximity to the junction between the neck portion 20 and the under surface 22 of the torso 13. A rearward connecting rib 25 (FIGS. 2 and 4)—which may be disposed parallel to the forward connecting rib 24—also extends downwardly from the under surface 22 of the torso 13 but is disposed to extend laterally between the hind legs 16 and 18. Hence, the rearward connecting rib 24 is located rearwardly of the seating portion 23.

Figure 6:
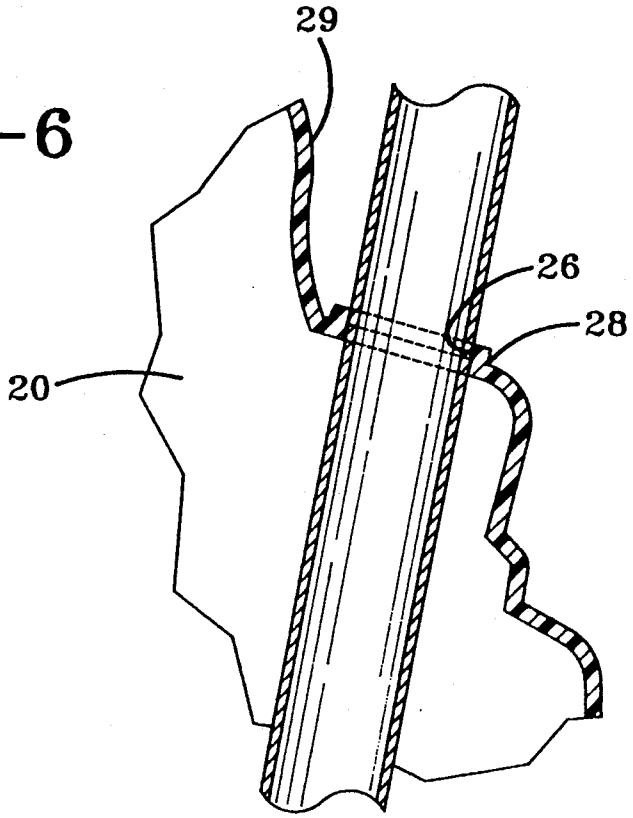
FIG. 6 is an enlarged area of FIG. 2—as designated by the appropriately identified chain line circle in FIG. 2—depicting the interconnection between the upper surface on the neck of the animal replica and the vertically extending pole on the frame.
Figure 7:
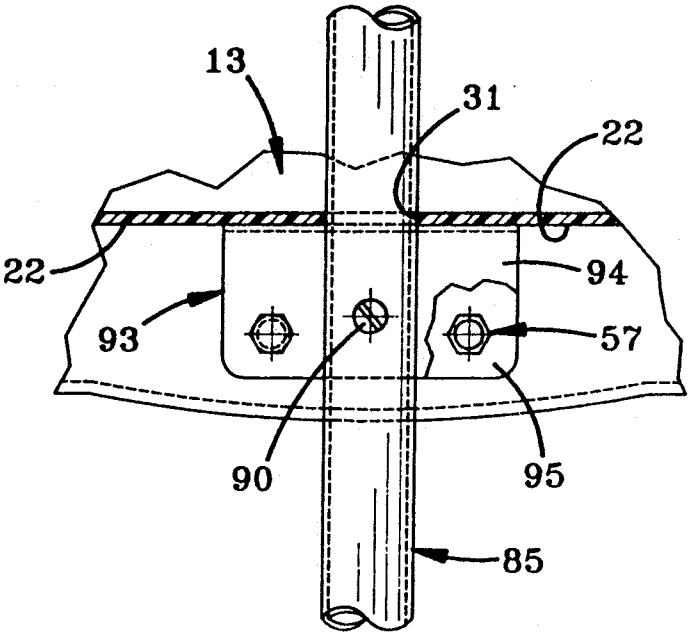
FIG. 7 is an enlarged, cross sectional view taken substantially along line 7—7 of FIG. 2.

As best seen in FIGS. 2 and 6, the neck portion 20 of the replica 11 has an aperture 26 which passes through a generally horizontally oriented stepped portion 28 in the upper surface 29 of the neck portion 20. The stepped portion 28 can easily be incorporated in the design of the mane 30 (FIG. 1) so that it will be relatively inconspicuous. As best seen in FIGS. 2 and 7, a second aperture 31 passes through the under surface 22 of the torso 13 and is disposed to register with the first aperture 26. This utilization of two vertically spaced, and registered, apertures 26 and 31 is all that is required to define a substantially vertical passage 32 through the replica 11 when, as depicted, the replica 11 is hollow. Were the replica 11 solid, or even partially solid, the apertures 26 and 31 would define the upper and lower openings of a vertical passage 32 through the replica 11. In either event there is a passage 32 which will serve a purpose more fully hereinafter described.

The torso 13 of the animal replica 11 is secured to the platform 12 through the connecting ribs 24 and 25, but to facilitate that explanation it is preliminarily desirable to understand the construction of the platform 12. Specifically, the platform 12 has a pair of laterally spaced, substantially parallel, arcuate rocker members 33 and 34. The forward end portions of the rocker members 33 and 34 are connected by a transverse, forward cross bar 35, and the rearward end portions of the rocker members 33 and 34 are connected by a transverse, rearward cross bar 36. One convenient way by which to secure the cross bars 35 and 36 to the rocker members 33 and 34 is to provide the ends of each cross bar 35 and 36 with a tapered connecting section 38 (FIGS. 2 and 5) which extends substantially perpendicularly outwardly from the ends of each cross bar. The connecting section 38 is adapted to be received within the hollow ends of the rocker members 33 and 34. A small screw 39, the head of which may be circumscribed by a protective grommet, can pass through the wall of the appropriate rocker member 33 or 34 to be threadably received within the wall of the connecting section 38 received therein in order to secure the connecting section 38 within the appropriate rocker member 33 or 34.

The rocker members 33 and 34 and the conjoined forward and rearward cross bars 35 and 36, respectively, constitute a frame 45 which delineates the outer perimeter, or envelope, of the platform 12. As best seen in FIG. 1, the outer perimeter delineated by the frame 45 of the platform 12 is larger than the replica 11—i.e., both the longitudinal and lateral dimensions of the frame 45 are larger than the corresponding dimensions of the replica 11.

The rocker members 33 and 34 are also joined by a transverse, arch supporting member 46. The transverse, arch supporting member 46 has a substantially linear central potion 48, one end of which terminates in a first, downwardly bowed leg portion 49 which is connected to one rocker member 33, that connection not being shown. The second end of the arch supporting member 46 terminates in a second, downwardly bowed leg portion 51 that is connected to the other rocker member 34, as at 52. The details of one acceptable connection will be hereinafter more fully described.

Figure 8:
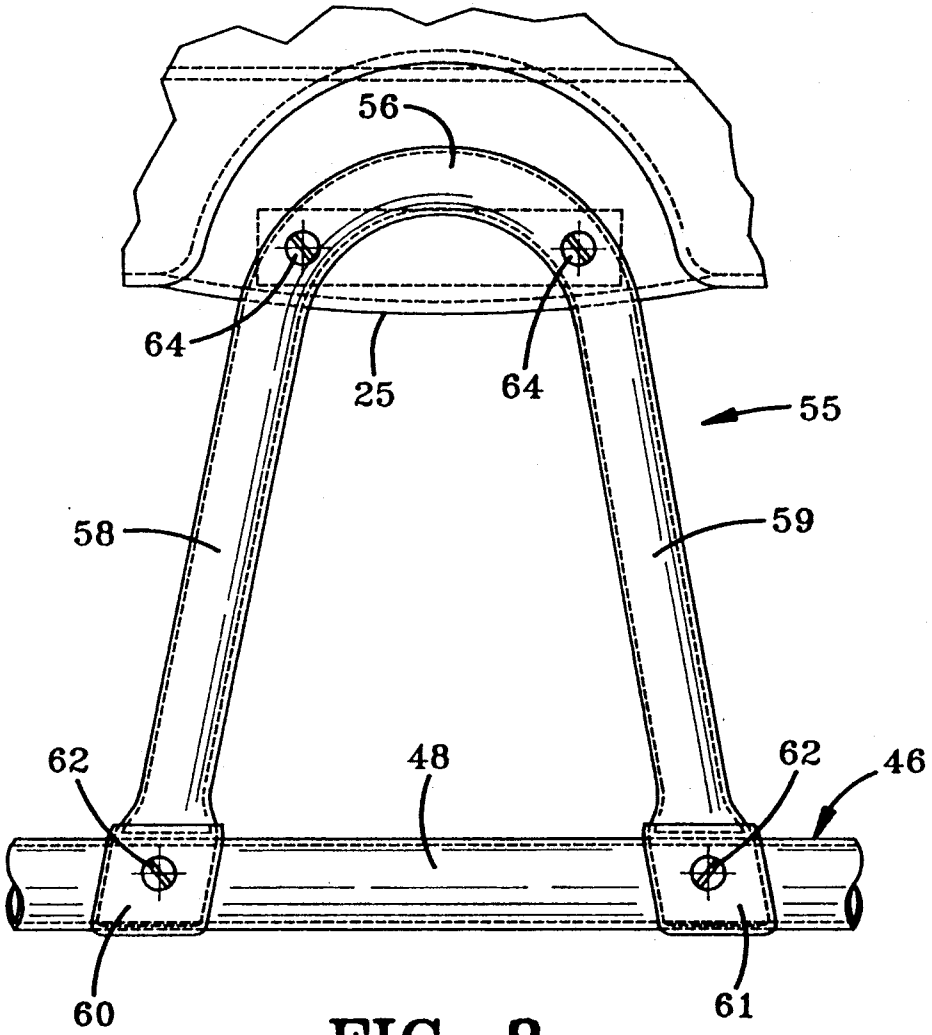
FIG. 8 is an enlarged cross sectional view taken substantially along line 8—8 of FIG. 2.

As best depicted in FIG. 2, the transverse, arch supporting member 46 is positioned to be aft of the seating portion 23 ad substantially below the juncture of the hind legs 16 and 18 to the torso 13 when the animal replica 11 is supported on the platform 12. Even so, the transverse, arch supporting member 46 is fastened to the rocker members 33 and 34 medially the ends thereof. A tubular U-shaped arch 55, which is most clearly depicted in FIG. 8, is secured to the linear central portion 48 of the transverse, arch supporting member 46. The arch 55 has a curved, central portion 56 which is interposed between linear extension portions 58 and 59. The outer ends 60 and 61 of each tubular extension portion 58 and 59 may be flattened, and then cylindrically curved, as shown, to engage the outer surface of the linear central portion 48 on the transverse, arch supporting member 46. A bolt 62 passes through each flattened, and curved, outer end 60 and 61 and through the central portion 48 of the arch supporting member 46 to be secured by a nut, not shown, in a standard arrangement.

Figure 4:
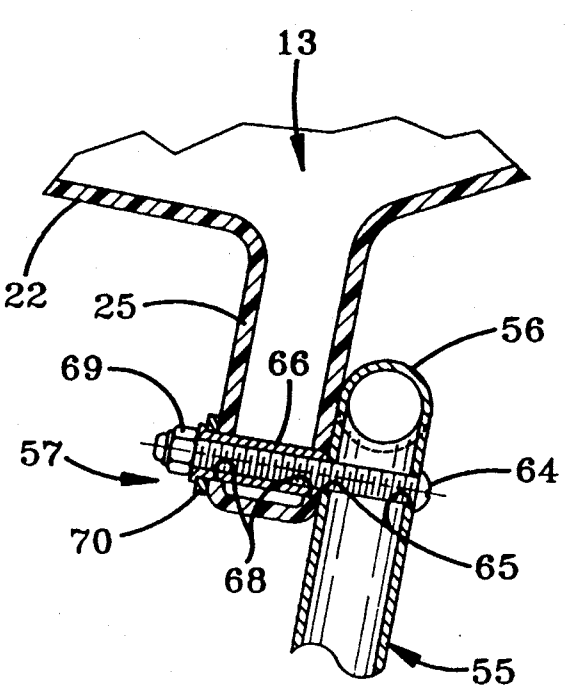
FIG. 4 is an enlarged area of FIG. 2—as designated by the appropriately identified chain line circle in FIG. 2—depicting the interconnection between the body portion of the animal replica and a body support means which extends upwardly from a transverse supporting member on the platform.

The curved central portion 56 of the arch member 55 is secured to the rear connecting rib 25 by a fastening arrangement 57 which is represented in detail in FIG. 4. Specifically, a pair of bolts 64 pass through appropriately spaced apertures 65 which pierce the central portion 56 of the arch 55 as well as through a thimble 66 received in the aligned apertures 68 in the connecting rib 25 to be secured by a nut 69. Because the arch 55 is preferably metallic, it normally has generally sufficient transverse strength to withstand the crushing effect which exists when the nut 69 is tightened onto the bolt 64. However, inasmuch as the torso 13 is generally fabricated from some plastic material, a rigid thimble 66 is preferably employed to enhance the strength of the connecting rib 25. In addition a stress plate 70 may also be interposed between the nuts 69 and the rear connecting rib 25. As should now be apparent, the transverse, arch supporting member 46, and the arch 55, when conjoined to the rear connecting rib 25, as described, supports the rear portion of the replica 11.

Figure 5:
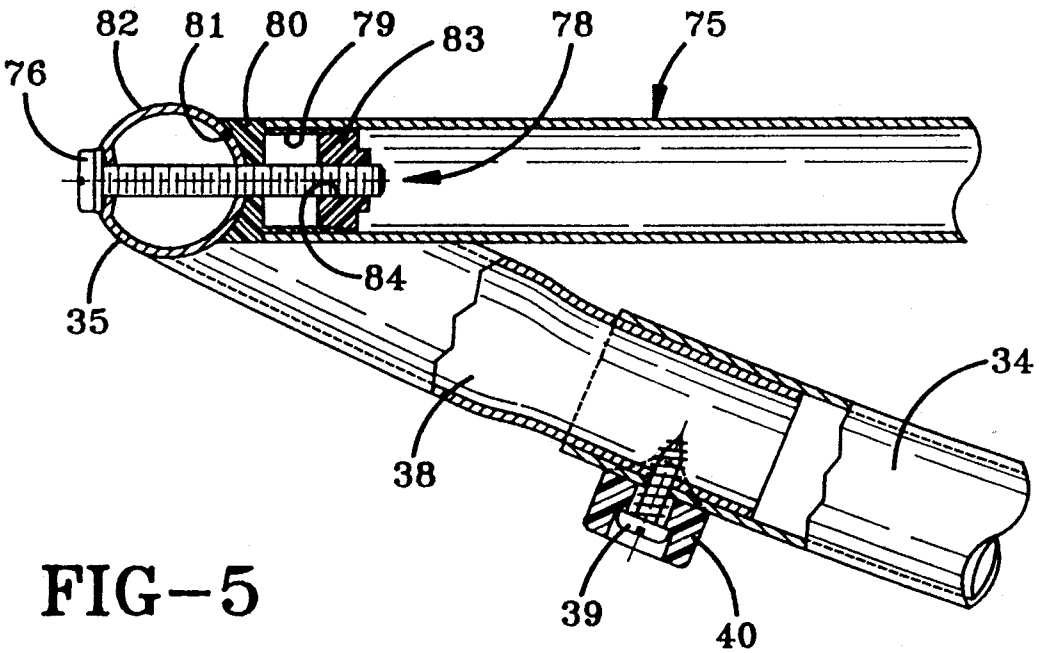
FIG. 5 is an enlarged area of FIG. 2—as designated by the appropriately identified chain line circle in FIG. 2—depicting the interconnection between a longitudinal support bar and the forward end bar of the platform.

A longitudinally extending beam member 75, which defines the longitudinal axis of the platform 12, is secured between the forward cross bar 35 and the linear central portion 48 of the transverse, arch supporting member 46. As best seen in FIG. 5, a bolt 76 passes through the forward cross bar 35 to be received within an anchor assembly 78 that is received within the hollow, longitudinal beam member 75 which, like the other components of the platform 12, may be tubular. The anchor assembly 78 has an annular body portion 79, one end of which presents an engaging head portion 80 with a cylindrically concave recess 81 to engage the outer surface 82 of the cross member 35. The opposite end of the body portion 78 terminates in a transverse block 83 that is penetrated by a threaded bore 84 to receive the bolt 76. A similar anchor assembly 78 may be received within the opposite end of the longitudinal beam member 75 to receive the bolt 76 by which to secure the longitudinal beam member 75 to the transverse, arch supporting member 46.

A carousel pole 85 is secured to and presented vertically upward from the longitudinal beam member 75. The carousel pole 85 passes through the passage 32 delineated by the registered apertures 26 and 31 and extends upwardly above the head and neck portion 19 and 20. The extension of the pole 85 above the upper surface 29 of the neck 20, and, in fact, above the head 19, provides a hand grip portion 86 for the rider of the rocking type ride-on toy 10. The vertically extended grip portion 86 permits the rider to grasp the pole 85 simply by extending the arms forwardly, irrespective of the height of the rider, and irrespective of whether the rider is seated or standing, as will become apparent.

The carousel pole 85 is secured to the longitudinal beam member 75. As shown in FIG. 2, a substantially right angled connector 88 may be employed. One leg 89 of the connector 88 may be flattened, and then cylindrically curved about the longitudinal axis of the leg 89, so that the flattened and curved portion of the leg 89 may engage a portion of the cylindrical outer surface of the longitudinal beam member 75 in order to permit the two nut and bolt combinations 90 rigidly to affix the connector 88 to the beam member 75. The second leg 91 of the connector 88 may be of reduced diameter so that it may be received within the lower, hollow end portion 92 of the carousel pole 85 and be secured therein by at least one nut and bolt combination 90.

As best represented in FIG. 3, a U-shaped bracket 93 may be employed to secure the pole 85 to the forward connecting rib 24. One leg 94 of the bracket 93 may be secured to the pole 85 by a standard nut and bolt combination 90. The other leg 95 of the bracket 93 may be secured to the forward connecting rib 24 by a fastening arrangement 57, the details of which have been previously herein described in conjunction with FIG. 4.

A foot supporting member, or foot rest, 96 is secured to, or otherwise formed on, the pole 85 at a position below the under surface 22 of the torso 13. The foot rest 96 is preferably attached to the pole 85 with fasteners which may be of the nut and bolt combination variety 90. A plurality of openings 98 are preferably provided along the appropriate portion of the pole 85 in order to permit positioning the foot rest 96 at various elevations. Thus, the length of the riders legs can be accommodated. The length of the hand grip portion 86 is sufficient to permit the rider to stand erect on the foot rests 96 while maintaining a grip on the pole 85 such that the awkward forward leaning of the rider's body is eliminated, even while standing.

The rectilinear configuration of the platform frame 45 provides a wide-base rigid supporting platform 12. The transverse arch supporting member 46 and the longitudinal beam member 75 add structural rigidity to the platform 12 and permit the animal replica 11 to be mounted by a rider from within the perimeter of the frame 45. The improves the lateral stability of the rocking type ride-on toy 10 both during the rocking action and while the rider is mounting and dismounting. The extended grip portion 86 of the carousel pole 85 above the replica 11 permits the rider to maintain an erect position, not only when seated on the saddle 23 but also while standing on the foot rest 96. The lateral and longitudinal stability of the toy 10 is maintained while the rider is in a standing position because of the lateral distance provided between the arcuate, rocker members 33 and 34.

The foregoing description of the exemplary embodiment of the invention has been presented for the purposes of illustration and description. It is not intended to be exhaustive or to limit the invention to the precise form disclosed. Obvious modifications or variations ore possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

As should now be apparent, the present invention not only teaches a unique platform 12 for a rocking type ride-on toy 10 embodying the concepts of the present invention but also accomplishes the other objects of the invention.

I claim:

1. A rocking type ride-on toy comprising:

a pair of laterally spaced rocker members having forward and rearward ends;

a forward cross bar interconnecting said rocker members at the forward end thereof;

a rearward cross bar interconnecting said rocker members at the rearward end thereof;

a transverse, arch supporting member interconnecting said rocker members medially the ends thereof;

a longitudinal beam means interconnecting said forward cross bar with said transverse arch supporting member at substantially midway between said rocker members;

an animal replica having at least a torso with an upper surface and an under surface;

a seating portion presented from said upper surface;

a rearward connecting rib presented from the under surface of said torso and being located rearwardly of said seating portion;

an arch extending upwardly from said transverse, arch supporting member and being secured to said rearward connecting rib to assist in supporting the torso;

a forward connecting rib presented from said under surface of said torso and being located forwardly of said seating portion;

an aperture extending vertically through said torso;

pole means extending upward from said longitudinal beam means and passing through said aperture for presenting a vertically oriented grip portion that extends upwardly of said torso; and, means securing said pole means to said forward connecting rib.

2. A rocking type ride-on toy, as set forth in claim 1, further comprising:

foot support means presented from said pole means for providing means to support the feet of a rider positioned on said seating portion.

3. A platform for a rocking type ride-on toy, the platform being adapted to support the replica of an animal body having a predetermined length and width, said platform comprising:

an outer envelope defined by a frame having a pair of laterally spaced, arcuate rocker members each having longitudinally spaced forward and rearward ends;

a forward, transverse cross bar interconnecting the forward ends of said rocker members;

a rearward, transverse cross bar interconnecting the rearward ends of said rocker members, said frame defining a space having predetermined length and width dimensions greater than the length and width dimensions of an animal replica to be mounted thereon;

a transverse, arch supporting member interconnecting said rocker members medially the ends thereof;

a longitudinal beam member interconnecting said forward cross bar with said transverse arch supporting member substantially midway between said rockers;

an animal replica having a torso with an upper surface and an under surface;

a seating portion presented from said upper surface;

a rearward connecting rib presented from the under surface of said torso and being located rearwardly of said seating portion;

an arch extending upwardly from said transverse, arch supporting member and being secured to said rearward connecting rib to support said torso;

a forward connecting rib presented from said under surface of said torso and being located forwardly of said seating portion;

an aperture extending vertically through said torso;

a carousel pole extending upward from said longitudinal beam member and through said aperture for presenting a vertical extension of a sufficient vertical extent for providing a rider grip portion when an animal replica is secured to the frame; and, means securing said carousel pole to said forward connecting rib.

4. A platform for a rocker type ride-on toy, as set forth in claim 3, further comprising:

foot supporting means secured to and presented laterally from said carousel pole for providing support for a rider.

* * * * *